US006731070B2

(12) United States Patent
Scholl et al.

(10) Patent No.: US 6,731,070 B2
(45) Date of Patent: May 4, 2004

(54) LOW-PRESSURE GAS DISCHARGE LAMP WITH A MERCURY-FREE GAS FILLING

(75) Inventors: Robert Peter Scholl, Roetgen (DE); Rainer Hilbig, Aachen (DE); Achim Koerber, Kerkrade (NL); Johannes Baier, Wuerselen (DE); Thomas Juestel, Aachen (DE); Peter J. Schmidt, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/167,181

(22) Filed: Jun. 11, 2002

(65) Prior Publication Data

US 2003/0001505 A1 Jan. 2, 2003

(30) Foreign Application Priority Data

Jun. 15, 2001 (DE) ..... 101 28 915

(51) Int. Cl.[7] ..... H01J 17/20; H01J 61/12

(52) U.S. Cl. ..... 313/643

(58) Field of Search ..... 313/637–643, 313/484–485

(56) References Cited

U.S. PATENT DOCUMENTS 3,764,843 A * 10/1973 Van Eijl et al. ..... 313/639

FOREIGN PATENT DOCUMENTS

| | | | |
|---|---|---|---|
| EP | 0316189 A2 | 5/1989 | ..... H01J/65/04 |
| EP | 0422816 A2 | 4/1991 | ..... H01J/65/04 |
| GB | 2014358 A | 8/1979 | |

* cited by examiner

*Primary Examiner*—Sandra O'Shea
*Assistant Examiner*—Sumati Krishnan
(74) *Attorney, Agent, or Firm*—Ernestine C. Bartlett

(57) ABSTRACT

A low-pressure gas discharge lamp having a gas discharge vessel containing a gas filling with a chalcogenide of the elements of the 4th main group of the periodic systems of elements and a buffer gas, and having inner or outer electrodes and means for generating and maintaining a low-pressure gas discharge.

11 Claims, 1 Drawing Sheet

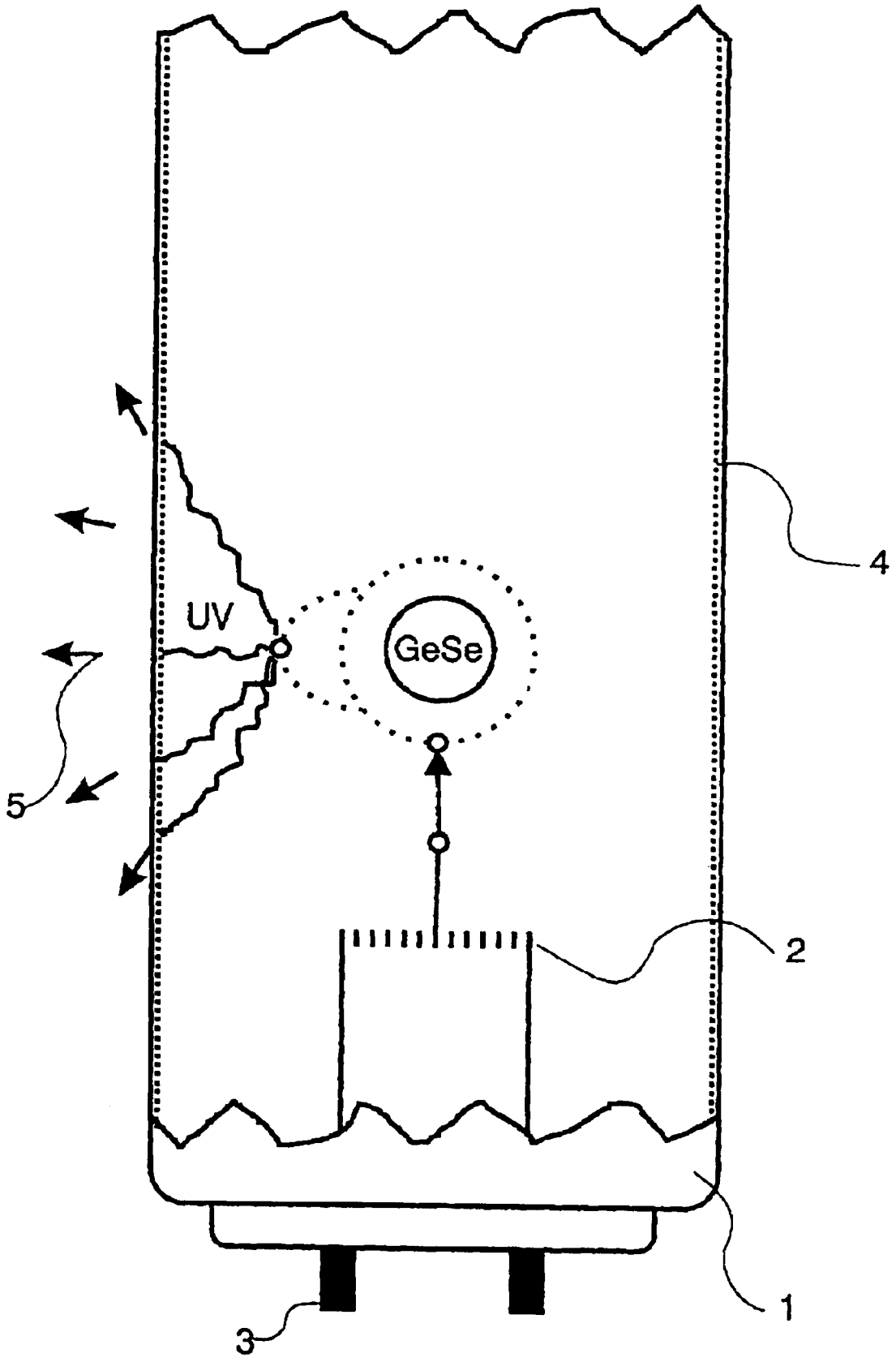
UV
GeSe
4
5
2
1
3

LOW-PRESSURE GAS DISCHARGE LAMP WITH A MERCURY-FREE GAS FILLING

The invention relates to a low-pressure gas discharge lamp comprising a gas discharge vessel with a gas filling, and comprising electrodes and means for generating and maintaining a low-pressure gas discharge.

Light generation in low-pressure gas discharge lamps is based on the principle that charge carriers, particularly electrons but also ions, are accelerated so strongly by an electric field between the electrodes of the lamp that collisions with the gas atoms or molecules in the gas filling of the lamp cause these gas atoms or molecules to be excited or ionized. When the atoms or molecules of the gas filling return to the ground state, a more or less substantial part of the excitation energy is converted to radiation.

Conventional low-pressure gas discharge lamps comprise mercury in the gas filling and, in addition, are equipped with a phosphor coating on the inside of the gas discharge vessel. A drawback of the mercury low-pressure gas discharge lamps resides in that mercury vapor primarily emits radiation in the high-energy, yet invisible UV-C range of the electromagnetic spectrum, which radiation must first be converted by the phosphors to visible radiation having a much lower energy level. In this process, the energy difference is converted to undesirable thermal radiation.

In addition, the mercury in the gas filling is being regarded more and more as an environmentally harmful and toxic substance that should be avoided as much as possible in present-day mass products as its use, production and disposal pose a threat to the environment.

It is known already that the spectrum of low-pressure gas discharge lamps can be influenced by substituting the mercury in the gas filling with other substances.

For example, GB 2 014 358 A discloses a low-pressure gas discharge lamp comprising a discharge vessel, electrodes and a filling that contains at least one copper halogenide as the UV emitter. This copper halogenide-containing low-pressure gas discharge lamp emits in the visible range as well as in the UV range around 324.75 and 327.4 nm.

It is an object of the invention to provide a low-pressure gas discharge lamp the radiation of which is as close as possible to the visible range of the electromagnetic spectrum.

In accordance with the invention, this object is achieved by a low-pressure gas discharge lamp comprising a gas discharge vessel containing a gas filling with a chalcogenide of the elements of the 4th main group of the periodic system of elements and a buffer gas, and comprising inner or outer electrodes and means for generating and maintaining a low-pressure gas discharge.

In the lamp in accordance with the invention, a molecular gas discharge takes place at a low pressure, which gas discharge emits radiation in the visible and near UVA range of the electromagnetic spectrum. As this radiation originates from a molecular discharge, the type of chalcogenide, possible further additives as well as the internal pressure of the lamp and the operating temperature enable the exact position of the continuous spectrum to be controlled.

In combination with phosphors, the lamp in accordance with the invention has a visual efficiency which is substantially higher than that of conventional low-pressure mercury discharge lamps. The visual efficiency, expressed in lumen/Watt, is the ratio between the brightness of the radiation in a specific visible wavelength range and the energy for generating the radiation. The high visual efficiency of the lamp in accordance with the invention means that a specific quantity of light is obtained at a smaller power consumption.

The chalcogenides of the elements of the 4th main group of the periodic system of elements, for example silicon, germanium, tin and lead, have a high dissociation energy. As a result, during the gas discharge only a small proportion of the molecules in the gas phase is split by electron impact ionization, and only few chalcogenide ions occur during the gas discharge. This also has a favorable effect on the visual efficiency of the lamp.

In addition, the use of mercury is avoided.

As an UV-A lamp, the lamp in accordance with the invention is advantageously used for sunbeds, and as a disinfecting lamp and a lacquer-curing lamp. For general illumination purposes, the lamp is combined with appropriate phosphors. As the losses caused by Stokes' displacement are small, visible light having a high luminous efficiency above 100 lumen/Watt is obtained.

Within the scope of the invention it may be preferred that the chalcogenide is selected among the group consisting of the sulphides, selenides and tellurides.

Within the scope of the invention, it may be preferred that the element of the 4th main group of the periodic system of elements is selected among the group consisting of silicon, germanium, tin and lead.

It is particularly preferred that the chalcogenide is selected among the group consisting of SiS, GeS, GeSe, GeTe, SnS, SnSe and SnTe.

Particularly advantageous effects in relation to the state of the art are achieved if the gas filling comprises germaniumselenide GeSe. In this case, a gas discharge with a wide continuous spectrum is obtained.

It may alternatively be preferred that the gas filling comprises germaniumsulphide GeS. A gas filling comprising germaniumsulphide is characterized by a high vapor pressure.

A further improved efficiency is achieved if the gas filling comprises a mixture of two or more chalcogenides of silicon, germanium, tin and lead.

It is preferred that in the chalcogenide, the molar ratio n between the chalcogen and the element of the 4th main group of the periodic system of elements is $0.8 \leqq n \leqq 1.2$.

As the buffer gas, the gas filling may contain an inert gas selected among the group consisting of helium, neon, argon, krypton and xenon.

Within the scope of the invention it may be preferred that the gas discharge vessel comprises a phosphor coating on the outside surface. The UVA radiation emitted by the low-pressure gas discharge lamp in accordance with the invention is not absorbed by the customary glass types, but goes through the walls of the discharge vessel substantially free of losses. Therefore, the phosphor coating can be provided on the outside of the gas discharge vessel. This results in a simplification of the manufacturing process.

It may also be preferred that the gas discharge vessel comprises a phosphor coating on the inner surface.

These and other aspects of the invention are apparent from and will be elucidated with reference to the embodiment(s) described hereinafter.

In the drawing:

FIG. 1 diagrammatically shows the generation of light in a low-pressure gas discharge lamp comprising a gas filling containing germaniumselenide.

In the embodiment shown in FIG. 1, the low-pressure gas discharge lamp in accordance with the invention is composed of a tubular lamp bulb 1, which surrounds a discharge space. At both ends of the tube, inner electrodes 2 are sealed in, via which electrodes the gas discharge can be ignited. The low-pressure gas discharge lamp further comprises, in a manner which is known per se, an electrical ballast which is used to control the ignition and the operation of the gas discharge lamp.

The gas discharge vessel may alternatively be embodied so as to be a multiple-bent or coiled tube, and it may be surrounded by an outer bulb. The wall of the gas discharge vessel is preferably made of a glass type, quartz, aluminum oxide or yttrium-aluminum-granate.

For the gas filling use is made, in the simplest case, of a chalcogenide of silicon, germanium, tin and lead in a quantity of $2\times10^{-11}$ mol/cm$^3$ to $2\times10^{-9}$ mol/cm$^3$ and inert gas. The inert gas serves as a buffer gas enabling the gas discharge to be more readily ignited. For the buffer gas use is preferably made of argon. Argon may be substituted, either completely or partly, with another inert gas, such as helium, neon, krypton or xenon.

Chalcogenides are chemical compounds comprising a chalcogen, i.e. an element of the 6th main group of the periodic system of elements. Within the scope of the invention, use is preferably made of the chalcogenides comprising the chalcogens sulfur (S), selenium (Se) and tellurium (Te).

For the elements of the 4th main group of the periodic system of elements use can be made, within the scope of the invention, of the elements silicon (Si), germanium (Ge), tin (Sn) and lead (Pb).

For the invention use is preferably made of chalcogenides of the elements of the 4th main group of the periodic system of elements, wherein the molar ratio n between the chalcogen and the element of the 4th main group of the periodic system of elements is approximately $0.8 \leqq n \leqq 1.2$.

Table 1 shows a summary of the spectroscopic properties of some chalcogenides of the elements of the 4th main group of the periodic system of elements. T*[K] is the wall temperature of the lamp at which the partial vapor pressure of the chalcogenide reaches 10 $\mu$bar. In the column "Trans." the type of radiative transitions in the chalcogenide molecule is shown. "X" indicates the electronic ground state of the molecule, "A", "B", "D" and "E" indicate an electronically excited state of the molecule, "D[eV]" is the dissociation energy of the relevant chalcogenide and "$\lambda$*" indicates a characteristic wavelength of the molecular emission.

The efficiency can be improved by combining two or more chalcogenides of silicon, germanium, tin and lead in the gas atmosphere.

The efficiency can be further improved by optimizing the internal pressure of the lamp during operation. The cold filling pressure of the buffer gas is optimal if the product of the cold filling pressure of the buffer gas p and the smallest diameter of the gas discharge vessel d satisfies the condition 0.2 mbar cm<p.d<20 mbar cm.

It has been found that in accordance with a further advantageous measure, an increase of the lumen efficiency of the low-pressure gas discharge lamp can be achieved by controlling the operating temperature of the lamp by means of suitable constructional measures, so that during operation at an outside temperature of 25° C., an internal temperature in accordance with T*±50 [K] in accordance with Table 1 is achieved. The internal temperature T* relates to the coldest spot of the gas discharge vessel.

To increase the internal temperature, an outer bulb which is coated with an IR radiation-reflecting layer may be provided around the gas discharge vessel. Preferably, use is made of an infrared radiation-reflecting coating of indium-doped tin oxide.

A suitable material for the electrodes in the low-pressure gas discharge lamp in accordance with the invention consists, for example, of nickel or a nickel alloy, or of a metal having a high melting point, in particular tungsten and tungsten alloys, particularly tungsten alloys with rhenium. Also composite materials of tungsten with thorium oxide or indium oxide can suitably be used. The electrodes may additionally be coated with a material having a low work function.

In the embodiment in accordance with FIG. 1, the outside surface of the gas discharge vessel of the lamp is coated with a phosphor layer 4. The UV radiation originating from the gas discharge excites the phosphors in the phosphor layer so as to emit light in the visible range 5.

The chemical composition of the phosphor layer determines the spectrum of the light or its tone. The materials that can suitably be used as phosphors must absorb the radiation generated and emit said radiation in a suitable wavelength range, for example for the three primary colors red, blue and green, and enable a high fluorescence quantum yield to be achieved.

Suitable phosphors and phosphor combinations must not necessarily be applied to the inside of the gas discharge vessel, they may alternatively be applied to the outside of the gas discharge vessel as the customary glass types do not absorb radiation generated in the UVA range.

In accordance with another embodiment, the lamp is capacitively excited using a high-frequency field having a frequency of, for example, 2.65 MHz, 13.56 MHz or 2.4 GHz, where the electrodes are provided on the outside of the gas discharge vessel.

In accordance with a further embodiment, the lamp is inductively excited using a high-frequency field having a frequency of, for example, 2.65 MHz, 13.56 MHz or 2.4 GHz.

When the lamp is ignited, the electrons emitted by the electrodes excite the atoms and molecules of the gas filling so as to emit UV radiation from the characteristic radiation and a continuous molecular spectrum.

The discharge heats up the gas filling such that the desired vapor pressure and the desired operating temperature are achieved at which the light output is optimal.

The radiation from the chalcogenide-containing gas filling generated during operation exhibits, apart from the line spectrum of the elements of the 4th main group of the periodic system, an intense, wide, continuous molecular spectrum which is brought about by molecular discharge of the chalcogenide. The maximum emission range of the continuous molecular spectrum usually shifts to longer wavelengths as the molecular weight of the chalcogenide increases.

TABLE 1

| | Properties of chalcogenides | | | |
|---|---|---|---|---|
| | T*[K] | Trans. | D[eV] | $\lambda$*[nm] |
| SiS | 870 | E→X | 6.4 | 238 |
| | | D→X | | 285 |
| GeS | 640 | E→X | 5.67 | 257 |
| | | A→X | | 304 |
| GeSe | 670 | E→X | 4.9 | 282 |
| | | A→X | | 324 |
| GeTe | 760 | E→X | 4.2 | 318 |
| | | A→X | | 360 |
| SnS | 850 | B→X | 4.77 | 423 |
| | | A→X | | 436 |
| SnSe | 850 | E→X | 4.2 | 325 |
| | | D→X | | 363 |
| SnTe | | B→X | 3.69 | 490 |
| | | A→X | | 594 |

EXAMPLE 1

A cylindrical discharge vessel of glass that is transparent to UVA radiation, having a length of 14 cm and a diameter of 2.5 cm is provided with outer electrodes of copper. The discharge vessel is evacuated and simultaneously a dose of 0.3 mg GeSe is added. Also argon is introduced at a cold pressure of 5 mbar. An alternating current with a frequency of 13.65 MHz originating from an external alternating current source is supplied, and the lumen efficiency is measured at an operating temperature of 433° C. The lumen efficiency is 100 Lm/W.

What is claimed is:

1. A low-pressure gas discharge lamp comprising a gas discharge vessel containing a gas filling with a chalcogenide of a chalcogen and one of the elements of the $4^{th}$ main group of the periodic system of elements and a buffer gas, and comprising inner or outer electrodes and means for generating and maintaining a low-pressure gas discharge, characterized in that the chalcogenide is present in the amount of about $2\times10^{-11}$ mol/cm$^3$ to $2\times10^{-9}$ mol/cm$^3$.

2. A low-pressure gas discharge lamp as claimed in claim 1, characterized in that the chalcogenide is selected from the group consisting of the sulphides, selenides and tellurides.

3. A low-pressure gas discharge lamp as claimed in claim 1, characterized in that the elements of the $4^{th}$ main group of the periodic system of elements is selected from the group consisting of silicon, germanium, tin and lead.

4. A low-pressure gas discharge lamp as claimed in claim 1, characterized in that the chalcogenide is selected from the group consisting of SiS, GeS, GeSe, GeTe, SnS, SnSe and SnTe.

5. A low-pressure gas discharge lamp as claimed in claim 1, characterized in that the gas filling comprises germanium_selenide (GeSe).

6. A low-pressure gas discharge lamp as claimed in claim 1, characterized in that the gas filling comprises germanium_sulphide (GeS).

7. A low-pressure gas discharge lamp as claimed in claim 1, characterized in that the gas filling comprises a mixture of two or more chalcogenides of silicon, germanium, tin and lead.

8. A low-pressure gas discharge lamp as claimed in claim 1, characterized in that in the chalcogenide, the molar ratio n between the chalcogen and the element of the $4^{th}$ main group of the periodic system of elements is $0.8 \leqq n \leqq 1.2$.

9. A low-pressure gas discharge lamp as claimed in claim 1, characterized in that the buffer gas comprises an inert gas selected from the group consisting of helium, neon, argon, krypton and xenon.

10. A low-pressure gas discharge lamp as claimed in claim 1, characterized in that the outside surface of the gas discharge vessel is provided with a phosphor coating.

11. A low-pressure gas discharge lamp as claimed in claim 1, characterized in that the inner surface of the gas discharge vessel is provided with a phosphor coating.

* * * * *